United States Patent [19]

Walusiak

[11] Patent Number: 5,063,978

[45] Date of Patent: Nov. 12, 1991

[54] APPARATUS FOR FILLING CONTAINERS

[75] Inventor: Jacek Walusiak, Hamburg, Fed. Rep. of Germany

[73] Assignee: alfill Getränketechnik GmbH, Hamburg, Fed. Rep. of Germany

[21] Appl. No.: 542,719

[22] Filed: Jun. 22, 1990

[30] Foreign Application Priority Data

Jun. 27, 1989 [DE] Fed. Rep. of Germany ..... 3920977

[51] Int. Cl.[5] ..... B67C 3/26; B65B 43/42

[52] U.S. Cl. ..... 141/263; 141/147; 141/165; 141/144

[58] Field of Search ..... 141/263, 147, 144, 146, 141/165, 129, 135, 152, 177, 266, 270, 277, 278

[56] References Cited

U.S. PATENT DOCUMENTS

| | | | |
|---|---|---|---|
| 2,913,016 | 11/1959 | Luther | 141/147 |
| 3,760,853 | 9/1973 | Trusselle | 141/146 |
| 4,319,613 | 3/1982 | Mette | 141/147 |
| 4,674,547 | 6/1987 | Simonazzi | 141/263 |
| 4,750,533 | 6/1988 | Yun | 141/46 |
| 4,787,427 | 11/1988 | Bacroix | 141/39 |
| 4,938,261 | 7/1990 | Petri et al. | 141/147 |

*Primary Examiner*—Henry J. Recla
*Assistant Examiner*—Keith Kupferschmid
*Attorney, Agent, or Firm*—Peter K. Kontler

[57] ABSTRACT

The centering nozzles of continuously orbiting material-supplying valves in a filling machine wherein cans, bottles or other types of containers are moved into register with and advance with the valves in the course of the filling operation are biased toward the material-receiving portions of registering containers by mechanical springs or by pneumatic cylinder and piston units in order to ensure that the nozzles can yield when necessary so as to preserve the integrity of the valves and/or of the containers. The springs and/or the cylinder and piston units are interposed between the nozzles and the assemblies which serve to raise and lower the nozzles relative to the containers below them. The nozzles also serve as differential pistons to bias their sealing elements against the adjacent containers during actual admission of a flowable material.

6 Claims, 3 Drawing Sheets

APPARATUS FOR FILLING CONTAINERS

BACKGROUND OF THE INVENTION

The invention relates to improvements in apparatus for filling containers, and more particularly to improvements in apparatus of the type wherein the containers which are in the process of receiving metered quantities of flowable material (e.g., a liquid) are maintained in register with and advance with moving material-supplying members in the form of valves or the like. The containers which can be filled in the apparatus of the present invention can constitute bottles, jars, cans or other types of receptacles of the type having a material-receiving opening surrounding an inlet for admission of flowable material into the container.

It is often desirable or necessary to introduce flowable materials at an elevated pressure and to employ material-supplying members supporting reciprocable nozzles which act as differential pistons to urge sealing rings or otherwise configurated sealing elements against the material-receiving portions of containers in the course of a bottling or filling operation. The arrangement is normally such that the nozzle and the adjacent portion of the respective material-supplying member define a plenum chamber which receives a pressurized fluid serving to urge the sealing element on the nozzle into engagement with the material-receiving portion of the registering container. The nozzles further serve as a means for centering the containers with respect to the adjacent material-supplying members, and each nozzle is normally mounted for reciprocatory movement toward and away from engagement with the registering container. A drawback of conventional apparatus of the just described character is that the flowable material is likely to splash and leave the filled containers before such containers reach the capping station. Moreover, conventional bottling or filling apparatus cannot ensure reliable and reproducible filling of containers when the number of containers to be filed per unit of time is to exceed a relatively low value. Still further, the mobile parts and certain other parts of conventional apparatus are subject to extensive wear, and such parts must be machined and assembled with a high degree of precision in order to avoid their deformation or breakage and/or deformation or breakage of containers which are to be filled with a flowable material.

OBJECTS OF THE INVENTION

An object of the invention is to provide a novel and improved apparatus which can be used to fill bottles, cans or other types of containers at a frequency exceeding the maximum output of heretofore known apparatus.

Another object of the invention is to provide an apparatus wherein the parts are subject to less wear than in conventional apparatus even if such parts are not machined and/or assembled with a high degree of accuracy.

A further object of the invention is to provide novel and improved material-supplying members for use in the above outlined apparatus.

An additional object of the invention is to provide the apparatus with novel and improved means for displacing the container centering and sealing devices.

A further object of the invention is to provide an apparatus which is or can be designed in such a way that flowable materials in filled containers are less likely to splash during transport in the apparatus or from the apparatus on to a further processing station.

Still another object of the invention is to provide novel and improved means for preventing the combined centering and sealing devices from impacting against empty containers with a force which would be likely to entail damage to such devices, to the means for displacing the devices and/or to the containers.

SUMMARY OF THE INVENTION

The invention is embodied in an apparatus which is used to admit flowable materials into moving containers having material-receiving portions defining inlets for flowable materials. The improved apparatus comprises at least one material supplying member, means for moving the at least one member along a predetermined path, means for advancing successive containers into positions of register with the at least one member, a combined centering and sealing device which is mounted on the at least one member for displacement toward and away from engagement with the material-receiving portion of a container which is in register with the at least one member, means for displacing the combined centering and sealing device, and yieldable energy storing means operating between the combined centering and sealing device and the displacing means to effect a movement of the combined centering and sealing device into engagement with the material-receiving portion of a container which is in register with the at least one member.

The combined centering and sealing device can be provided with a recess, and the displacing means can comprise motion transmitting output means in the recess. The energy storing means of such apparatus can comprise a spring which reacts against the motion transmitting output means and bears against the combined centering and sealing device. The recess can include or consist of an external annular groove in the combined centering and sealing device, and the latter can be provided with a flange which is adjacent the groove. The aforementioned spring can include or constitute a compressible spring which is at least partially disposed in the groove and bears against the flange of the combined centering and sealing device.

Alternatively, the combined centering and sealing device can be provided with an external recess and can include a motion receiving portion which is form-lockingly received in the recess. The energy storing means of such apparatus can comprise a cylinder and piston unit between the displacing means and the motion receiving portion of the combined centering and sealing device. The cylinder and piston unit can comprise a cylinder element which defines a chamber, and a piston element which extends into the chamber. One of these elements is provided on the motion receiving portion of the combined centering and sealing device, and the other of these elements is then provided on the displacing means. The energy storing means of such apparatus can comprise means for supplying a pressurized gaseous fluid into the chamber of the cylinder element. The means for supplying a pressurized gaseous fluid can be used in addition to or in lieu of a spring which is installed in the chamber to react against the other element and to bear against the one element. The at least one member can comprise guide means for the other element.

The displacing means can comprise a cam which is adjacent the predetermined path, and a follower which is adjacent the energy storing means and is movable with the at least one member to track the cam. The cam has a cam face for the follower, and the cam face can include portions which support the follower from below while the follower tracks a predetermined portion of the cam face. The advancing means of such apparatus can include means for delivering successive containers into register with the at least one member when the at least one member moves along a first portion of the predetermined path, and the apparatus can further comprise means for removing successive filled containers from positions of register with the at least one member when the at least one member moves along a second portion of the path. One portion of the cam face is adjacent the first portion and another portion of the cam face is adjacent the second portion of the predetermined path.

The predetermined path can include a first portion or section along which the at least one member moves prior to and a second portion or section along which the at least one member moves during admission of flowable material into a container which registers with the at least one member. The cam has a portion which is tracked by the follower during movement of the at least one member along the first portion or section of the predetermined path and which causes the follower to bear upon the energy storing means. The second portion or section of the predetermined path is located downstream of the first portion or section as seen in the direction of movement of the at least one member.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
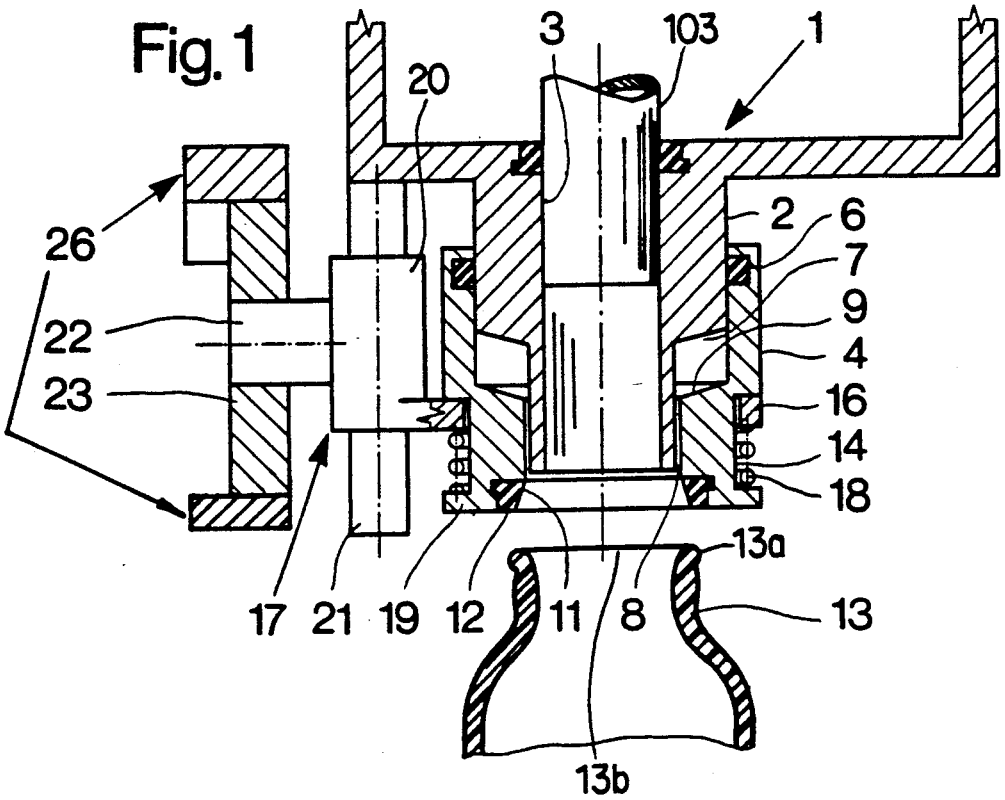
FIG. 1 is a fragmentary central vertical sectional view of a portion of a first apparatus wherein the energy storing means between each displacing means and the respective combined centering and sealing device comprises a coil spring in an external circumferential groove of the device, the device being shown in a raised position above and away from the material-receiving portion of a container.
Figure 2:
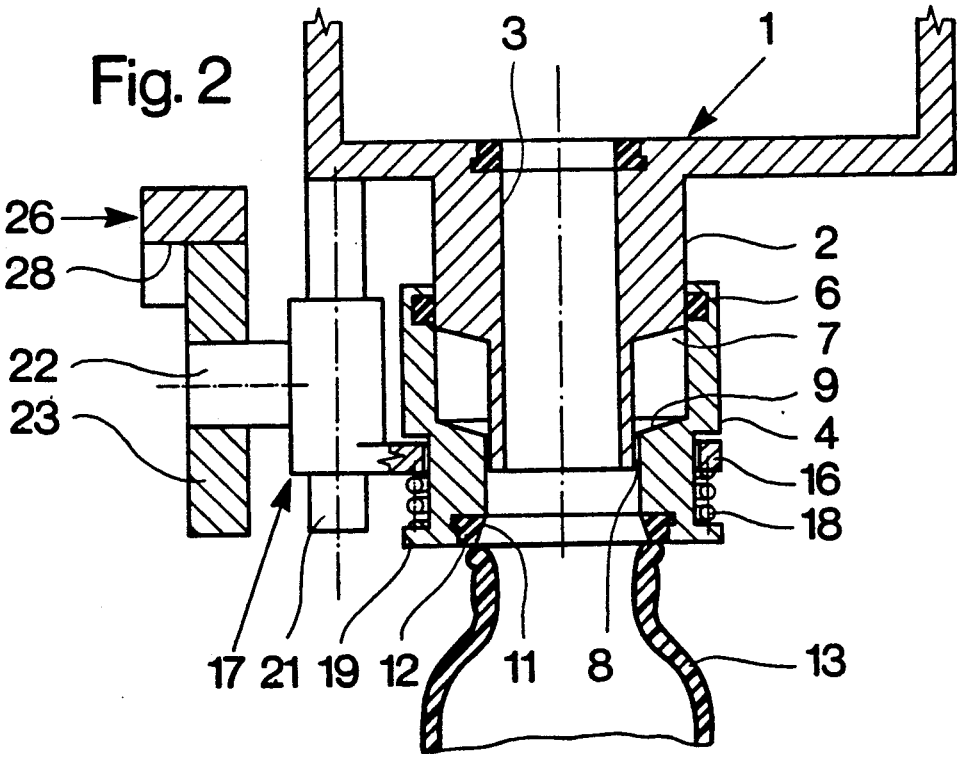
FIG. 2 shows the structure of FIG. 1 but with the combined centering and sealing device in lowered position in which a ring-shaped seal of the device engages the container around the material-admitting inlet.
Figure 3:
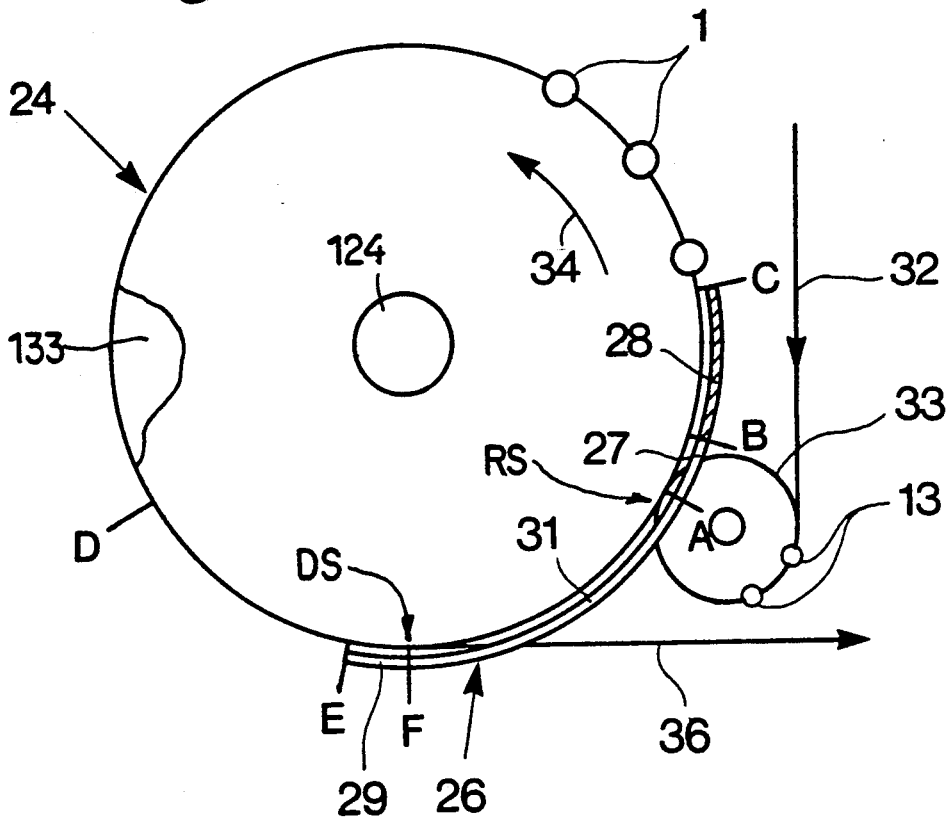
FIG. 3 is a schematic plan view of the apparatus which embodies the structure of FIGS. 1 and 2, a portion of a stationary cam of the means for displacing the combined sealing and centering devices on the material-supplying members being broken away.

Referring first to FIGS. 1 to 3, there is shown an apparatus which serves to fill successive containers 13 (e.g., standard bottles of glass or plastic material) with a flowable material, particularly with a liquid which is admitted at an elevated pressure. Each container 13 has a material-receiving portion 13*a* which defines and surrounds an inlet 13*b* for admission of flowable material, e.g., a beverage. The apparatus comprises a circular array of equidistant material-supplying members or valves 1 which are mounted at the periphery of a moving means 24 here shown as a platform or turntable 24 rotatable about a vertical axis which is equidistant from the members 1. These members are moved along an endless path in the direction of arrow 34. Each member 1 has a tubular portion 2 which is secured to the turntable 24 and is surrounded by a combined centering and sealing device 4 in the form of a nozzle which is displaceable up and down (between the positions which are shown in FIGS. 1 and 2) by a displacing means 17 with assistance from or against the resistance of an energy storing device in the form of a coil spring 18.

The means for advancing successive empty containers 13 to positions of register with successive material-supplying members 1 (and hence to positions of register with the respective nozzles 4) comprises a turnstile-like feeder 33 and a support 133 beneath the turntable 24. The support 133 can be driven by a shaft 124 which transmits torque to the turntable 24 in order to ensure that a container 13 which has been moved to a position of register with the nozzle 4 on the tubular portion 2 of the respective member 1 thereupon remains in such position of register during advancement along a certain section of the endless circular path for the members 1, namely between a receiving station RS and a discharging station DS. The arrow 32 denotes in FIG. 3 the direction of delivery of a row or file of empty containers 13 to the feeder 33 at the receiving station RS, and the arrow 36 denotes the direction of transport of filled containers from the discharging station DS. The turntable 24 and the feeder 33 can be driven continuously or intermittently.

FIGS. 1 and 2 show the important details of those parts of the improved apparatus which cooperate with one of the material-supplying members 1 to ensure predictable and rapid admission of metered quantities of a flowable material into successive empty containers 13. The nozzle 4 is slidable along the tubular portion 2 of the member 1 and its lower end face is provided with a recess for a sealing ring 12 having a downwardly diverging frustoconical internal surface 11 serving to direct a stream of flowable material into the inlet 13*b* of the material-receiving portion 13*a* of a container 13 which is then aligned with the member 1. The lower end face of the sealing ring 12 bears upon the top face of the material-receiving portion 13*a* when the displacing means 17 is caused to shift the nozzle 4 downwardly, i.e., from the raised position of FIG. 1 to the lowered position of FIG. 2.

A second sealing ring 6 (such as an O-ring) is installed in a recess which is provided therefor in the internal surface of the nozzle 4; the ring 6 sealingly engages the external surface of the tubular portion 2 in each axial position of the nozzle 4 relative to the corresponding material-supplying member 1.

The axial bore or hole 3 of the tubular portion 2 serves to receive the discharge end of a flexible hose 103 or another suitable conduit which connects the member 1 with a source of supply of flowable material, e.g., with a tank wherein the flowable material is or can be maintained at an elevated pressure.

The nozzle 4 and the tubular portion 2 define an annular plenum chamber 7 the volume or capacity of which varies in response to axial displacement of the nozzle between the raised and lowered positions of FIGS. 1 and 2. This plenum chamber receives a pressurized fluid by way of an annular clearance 8 between the smaller-diameter lower section of the tubular portion 2 and the adjacent lower portion of the nozzle 4 above the sealing ring 12. The lower end of the annular plenum chamber 7 is bounded by an upwardly diverging frustoconical surface 9 of the nozzle 4. The arrangement is such that, when the nozzle 4 is lowered to assume the position of FIG. 2 and the bore or hole 3 admits a pressurized fluid into the interior of the aligned container 13 (and hence into the annular clearance 8), the pressurized fluid also fills the chamber 7 and exerts pressure upon the surface 9 to urge the sealing ring 12 against the top face of the material-receiving portion 13*a;* the latter engages the sealing ring 12 at or along the downwardly and outwardly diverging frustoconical surface 11. The nozzle 4 is then subjected the the action of differential pressure to ensure that its ring 12 reliably (sealingly) engages the material-receiving portion 13*a* of the adjacent container 13 which moves with the respective material-supplying member 1 along the endless path in the direction of arrow 34.

The external surface of the nozzle 4 is provided with a recess 14 in the form of a circumferentially complete groove the lower end of which is adjacent an annular flange 19 of the nozzle. The groove 14 receives at least the major part of a compressible coil spring 18 as well as an annular motion transmitting output element 16 of the displacing means 17. The spring 18 reacts against the output element 16 and bears against the flange 19 so that, when the nozzle 4 is raised above a container 13 on the support 133, the spring 18 is free to maintain the upper side of the output element 16 in contact with the surface bounding the upper end of the groove 14 (see FIG. 1).

The displacing means 17 further comprises a sleeve 20 which is reciprocable along a vertical guide 21 of the material-supplying member 1. The sleeve 20 is provided with a radially extending stud 22 which rotatably supports a roller follower 23 serving to track the face of a stationary cam 26 extending along a certain length of the endless circular path for the material-supplying members 1. The cam 26 can induce the roller follower 23 to move the sleeve 20, and hence the output element 16, downwardly to stress the coil spring 18 in order to shift the nozzle 4 from the raised position of FIG. 1 to the lowered position of FIG. 2. It will be noted that the spring 18 operates between the displacing means 17 and the nozzle 4, i.e., the spring reacts against the output element 16 and bears against the flange 19.

The configuration of the cam face on the stationary cam 26 for the roller follower 23 will be described with reference to FIG. 3. The cam 26 extends along an arc of approximately 90° from the receiving station RS toward the discharging station DS (as seen in the direction of arrow 34) as well as in the opposite direction. A first portion or section 27 of the face of the cam 26 between the points A and B is designed to cause the roller follower 23 of a displacing means 17 to lower the respective nozzle 4 through the medium of the spring 18 so that the sealing ring 12 moves from the raised position of FIG. 1 to the lowered position of FIG. 2. The section 27 between the points A and B is followed by a portion or section 28 between the points B and C along which the roller follower 23 advances while the pressure in the registering container 13 and in the corresponding chamber 7 is raised. The section 28 is followed by a portion or section between the points C and D, by a section or portion between the points D and E, and this section is followed by a portion or section 29 between the points E and F where the nozzle 4 is lifted above and away from the filled container 13. The section 29 is followed by a portion or section 31 between the points F and A along which the roller follower 23 advances to maintain the respective nozzle 4 in the raised position of FIG. 1.

The operation of the apparatus is as follows:

The feeder 33 receives empty containers 13 in the direction of arrow 32 and delivers successive empty containers to positions of register with successive material-supplying members 1 on the turntable 24. The registering containers 13 are carried by the support 133 and advance at the speed of the material-supplying members 1 so that their axes coincide with the axes of the respective nozzles 4 all the way during transport from the receiving station RS (at A) to the discharging station DS (at F). The nozzle 4 on the tubular portion 2 of a material-supplying member 1 which has arrived at the receiving station RS is held (by the respective output element 16) in a raised position corresponding to that of the nozzle 4 which is shown in FIG. 1. As the member 1 moves along the section or portion 27 of the face of the stationary cam 26, the roller follower 23 is free to descend by gravity so that the combined weight of the roller follower 23, stud 22, sleeve 20 and output element 16 suffices to lower the nozzle 4 by way of the spring 18 from the raised position of FIG. 1 to the lowered position of FIG. 2, i.e., the sealing ring 12 of the nozzle 4 comes into abutment with the material-receiving portion 13*a* of the adjacent container 13. If and when necessary, the frustoconical surface 11 of the sealing ring 12 centers the adjacent container 13 relative to the material-supplying member 1 before the container receives a metered quantity of flowable material via bore or hole 3.

Prior to admission of flowable material, the sealing ring 12 must be biased against the material-receiving portion 13*a* of the adjacent container 13 with a certain force which is or can be furnished by the spring 18 and by the displacing means 17 during advancement of the container between B and C. FIG. 2 shows that portion or section (28) of the face on the cam 26 which causes the roller follower 23 to move the output element 16 away from the surface above the groove 14 while the sealing ring 12 abuts the material-receiving portion 13*a* so that the spring 18 is compelled to store energy, or to store additional energy, and to cause the sealing ring 12 to bear against the container with a preselected force depending upon the width of the gap between the upper side of the output element 16 and the surface bounding the topmost portion of the groove 14.

The pressure in the container 13 (and hence in the clearance 8 and chamber 7) is increased while the container advances past the point C. Such rise of pressure in the chamber 7 causes the nozzle 4 to act as a differential piston and to urge the ring 12 against the material-receiving portion 13a with a substantial force. When the pressure in the container 13 and in the chamber 7 reaches a predetermined value, the cam face is interrupted or raised so that the nozzle 4 is no longer mechanically urged toward the material receiving portion 13a. This can be achieved in a manner as shown in FIG. 3, i.e., by simply interrupting the cam 26 at or close to the point C and all the way to the point E.

The admission of pressurized flowable material takes place while the member 1 and the registering container 13 advance from the point C to the point D. The manner of admitting pressurized flowable material is well known, the same as the manner of admitting pressurized fluid into the chamber 7 (via clearance 8) and the manner of thereupon reducing the pressure in the chamber 7 (between D and E). The roller follower 23 thereupon returns into engagement with the face of the cam 26 and is lifted by the cam face while advancing from the point E to the point F. This results in displacement of the nozzle 4 from the lowered position of FIG. 2 to the raised position of FIG. 1, and the face of the cam 26 thereupon maintains the nozzle 4 in the raised position of FIG. 1 while the roller follower 23 advances from the point F to the point A. This enables a suitable removing device (e.g., a stationary deflector, not shown) to divert the filled container 13 from the support 124 into the straight path which is denoted by the arrow 36 and preferably extends tangentially of the endless circular path of the material-supplying members 1 on the turntable 24. The filled containers 13 are advanced to the next-following station, e.g., to a capping machine.

An important advantage of the improved apparatus is that it is not necessary to lift the containers 13 toward and into engagement with the nozzles of the material-supplying members. This simplifies the retention of containers 13 (on the support 133) in positions in which their axes are inclined to the vertical, namely in which the material-receiving portions 13a are located radially inwardly of the bottom portions of the respective containers 13. This is often desirable and advantageous, especially if the containers are to be filled with a hydraulic fluid, because the fluid is less likely to splash and to escape from the container by way of the material-receiving portion 13a during movement from the point D toward and beyond the point F (into the path which is designated by the line 36) while advancing in the direction of arrow 34. Such splashing is particularly likely to occur if the turntable 24 is rotated at an elevated speed.

The relatively long path for the material-supplying members 1 is, but need not always be, a circular path.

Another important advantage of the improved apparatus is that the springs 18 (or analogous energy storing means) compensate for tolerances in the machining and assembly of component parts of the apparatus because each of these springs acts not unlike a cushion which is interposed between the nozzle 4 and the respective displacing means 17. Furthermore, the springs 18 reduce the wear upon and the likelihood of breakage of component parts of the apparatus because they enable the nozzles 4 to yield by moving upwardly, e.g., when the height of each of a shorter or longer series of containers 13 is not the same. Such springs can also compensate for eventual wobbling of the turntable 24 and/or support 133.

Each spring 18 can be designed in such a way that its bias suffices to maintain the respective nozzle 4 in contact with the adjacent material-receiving portion 13a while the container 13 is on its way toward the point (as at C) where the pressure in the chamber 7 is raised so that the nozzle 4 acts as a differential piston and biases the sealing ring 12 against the portion 13a with a requisite force. At the same time, the spring 18 prevents the output element 16 from acting directly upon the flange 19 which could result in damage to the nozzle and/or in breakage of the container 13, especially of a container which is made of a brittle material. In other words, the springs 18 prevent the application of excessive mechanical pressure directly from the displacing means 17 to the respective nozzles 4 (and hence to the containers 13 which are being centered and sealed by the nozzles).

Adequate sealing engagement between a ring 12 and the adjacent material-receiving portion 13a during admission of flowable material into the respective container 13 is ensured by pressurized fluid in the chamber 7, i.e., the spring 18 is not called upon to ensure such sealing engagement during that stage of advancement of a container 13 along the endless path for the members 1 when the container is in the process of receiving a preferably metered quantity of pressurized flowable material. All that a spring 18 is called upon to do is to bias the respective ring 12 against the adjacent material-receiving portion 13a during the relatively short interval of advancement of the nozzle 4 toward the station (at C) where the respective chamber 7 is filled with a pressurized fluid which enables the nozzle to act as a differential piston. Thus, the interval of time during which a spring 18 actually causes the respective ring 12 to bear against the registering container 13 constitutes but a small or minute fraction of the interval which is required by the turntable 24 to complete a full revolution about the axis of the shaft 124.

It has been found that the improved apparatus is capable of reliably and predictably filling containers 13 or analogous containers at a high frequency, without splashing of confined flowable material and with less pronounced wear upon the sensitive moving, displacing and advancing components than heretofore known apparatus. The roller followers 23 of the displacing means 17, the sleeves 20 and output elements 16 of such displacing means, as well as the guides 21 and the cam 26 are not subjected to extensive wear; this reduces the maintenance cost and renders it possible to operate the apparatus without interruptions for long periods of time.

The relatively short arcuate cam 26 of finite length can be replaced with a circumferentially complete ring-shaped cam without departing from the spirit of the invention. As a rule, it suffices to permit the roller follower 23 and the parts which are connected thereto to descend by gravity in order to move the respective nozzle 4 into initial engagement with the material-receiving portion 13a of the adjacent container 13. Therefore, the cam 26 can be interrupted along that portion of the path for the material-supplying members 1 which extends from the point C to the point E in FIG. 3.

Figure 4:
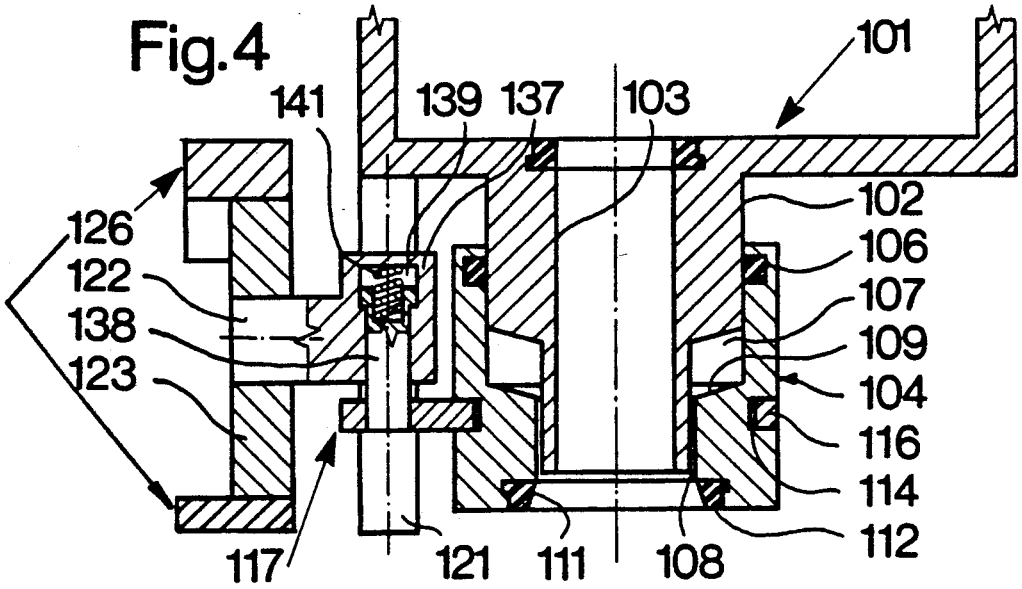
FIG. 4 is a fragmentary sectional view of a second apparatus wherein the energy storing means between the combined centering and sealing device and the respective displacing means is located in a cylinder chamber adjacent the main body portion of the device.

FIG. 4 shows a portion of a second apparatus wherein all such parts which are identical with or clearly analogous to corresponding parts of the apparatus of FIGS. 1 to 3 are denoted by similar reference characters plus 100. The main difference between the apparatus of FIGS. 1–3 and the apparatus of FIG. 4 is that the element 116 of FIG. 4 constitutes a motion receiving portion of the combined centering and sealing device or nozzle 104. To this end, the element 116 is snugly received in the external circumferential groove 114 of the main body portion or sleeve of the nozzle 104, i.e., without any axial play, and the coil spring 18 is replaced with a coil spring 141 acting in a chamber or compartment 139 between a vertically reciprocable piston element 138 on the element 116 (i.e., on the nozzle 104) and a cylinder element 137 which is reciprocable along the guide 121 of the member 101 and has a stud 122 for a roller follower 123 tracking the cam 126.

In FIG. 4, the nozzle 104 is maintained in raised position because the cam 126 maintains the roller follower 123 at the illustrated level, namely at a level such that the cylinder element 137 maintains the piston element 138 and the element 116 sufficiently close to the upper end of the tubular portion 102 to hold the sealing ring 112 above and away from the material-receiving portion 13*a* (not shown) of a container which is in register with the nozzle 104. The guide 121 extends through the cylinder element 137 behind the chamber or compartment 139 and behind the piston element 138. If the sealing ring 112 is to be lowered into engagement with a container below it, the cam 126 simply permits the roller follower 123 to descend by gravity or actually pushes the roller follower downwardly so that the cylinder element 137 descends along the guide 121 and causes the spring 141 to push the piston element 138 and its piston rod (such piston rod is anchored in the element 116) downwardly whereby the element 116 entrains the main body portion or sleeve of the nozzle 104 and the ring 112 until the ring 112 comes to rest on the material-receiving portion 13*a* of the container 13 beneath it. The spring 141 ensures that the internal surface of the cylinder element 137 at the top of the compartment 139 cannot strike directly against the upper end face of the piston element 138 in the compartment 139.

The manner in which the material-supplying member 101 is caused to move along a preferably endless circular path is or can be the same as described with reference to FIG. 3. The same applies for the action of the cam 126 upon the roller follower 123 of FIG. 4.

The positions of the piston element and cylinder element in the cylinder and piston unit including the parts 137, 138 can be interchanged, i.e., the piston element can be carried by the stud 122 and the cylinder element can be carried by the element 116.

Figure 5:
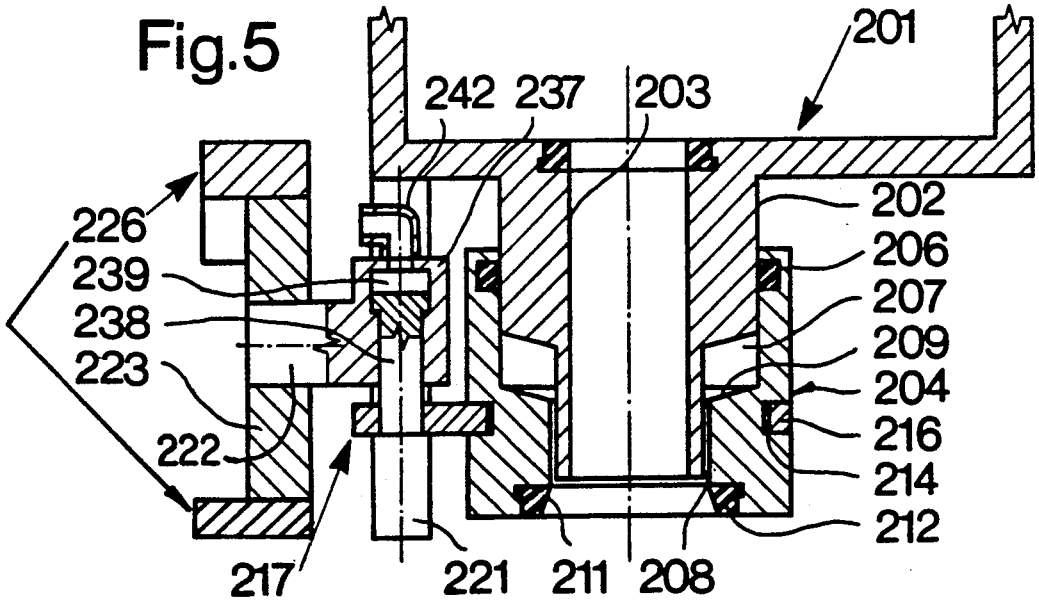
FIG. 5 is a similar fragmentary sectional view of a third apparatus constituting a modification of the apparatus a portion of which is shown in FIG. 4.

The apparatus which embodies the structure of FIG. 5 constitutes a modification of the apparatus which includes the structure of FIG. 4. All such parts of the apparatus of FIG. 5 which are identical with or clearly analogous to corresponding parts of the apparatus of FIG. 4 are denoted by similar reference characters plus 100. The main difference is that the cylinder and piston unit 237, 238 of FIG. 5 does not employ a coil spring (141 in FIG. 4) but rather a pressurized gaseous fluid which is admitted into the chamber or compartment 239 by way of a conduit 242 (e.g., from an accumulator or from another source) to constitute a cushion between the elements 237, 238, i.e., to perform the function of the spring 141 of FIG. 4. The conduit 242 can be connected to a source of compressed air or another gaseous fluid. As in the apparatus which embodies the structure of FIG. 4, the apparatus embodying the structure of FIG. 5 comprises, for each material-supplying member 201, a displacing means 217 including the cylinder and piston unit 237, 238, the stud 222, the roller follower 223 and the cam 226. FIG. 5 shows the nozzle 204 (this nozzle includes the element 216 and the main body portion or sleeve which carries the sealing ring 112) in the upper end position.

Figure 6:
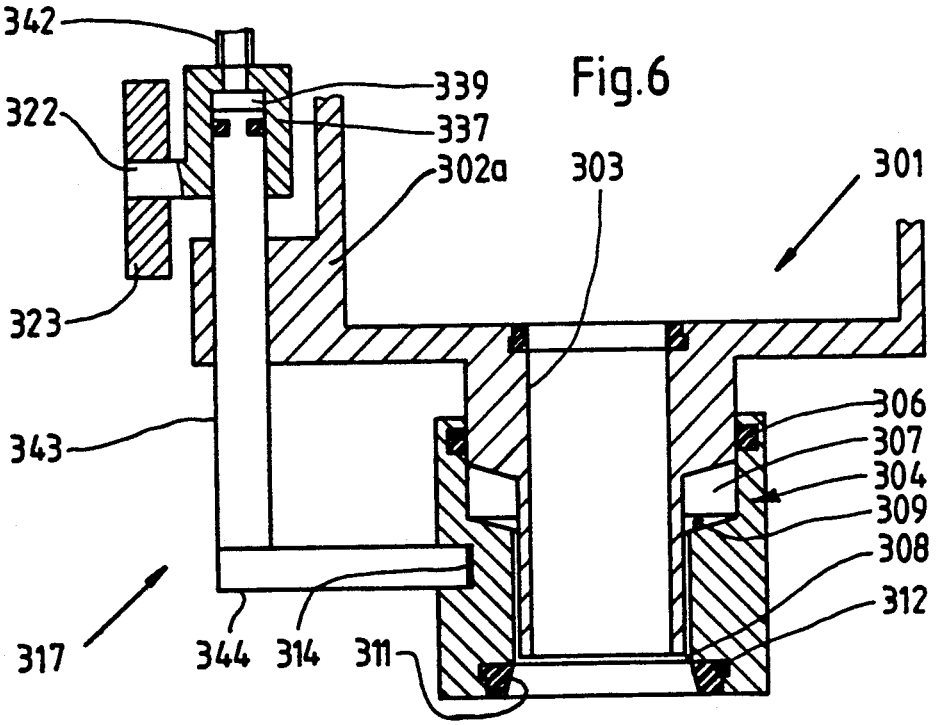
FIG. 6 is a fragmentary sectional view of a fourth apparatus constituting a modification of the apparatus a portion of which is shown in FIG. 5.

All such parts of the apparatus embodying the structure of FIG. 6 which are identical with or clearly analogous to the corresponding parts of the structure of FIG. 5 are denoted by similar reference characters plus 100. The structure of FIG. 6 need not employ a guide 21, 121 or 221; instead, a substantially upright rod-shaped component 343 of the composite nozzle 304 extends through a lateral extension 302*a* of the material-supplying member 301 and its lower end is connected to an element 344 extending into and being snugly received in a recess 314 (e.g., a radial blind hole or bore) in the main body portion or sleeve of the nozzle 304. The upper end portion of the rod-shaped component 343 constitutes a piston element or plunger which is reciprocable in and defines with the cylinder element 337 a chamber or compartment 339 which receives a pressurized gaseous fluid by way of a supply conduit 342. The cylinder element 337 is connected with the stud or shaft 322 for the roller follower 323 which tracks a cam (not shown) in substantially the same way as described in connection with the roller follower 23 and cam 26 of FIGS. 1 to 3. The energy storing means of the apparatus embodying the structure of FIG. 6 is the cushion of compressed gaseous fluid in the chamber or compartment 339.

The conduit 342 can be omitted if the chamber or compartment 339 receives a spring, e.g., a coil spring of the type shown (at 141) in FIG. 4.

The stud 322 can be connected to the component 343 if the cylinder and piston unit is installed between the element 344 and the lower end portion of the component 343, e.g., if the lower end portion of the component 343 constitutes a piston element or plunger extending into a gas-filled chamber or compartment of a cylinder element on the part 344.

Apparatus for filling containers under counterpressure are disclosed, for example, in U.S. Pat. Nos. 4,750,533, 4,787,427, 4,653,249 and 2,656,964 to which reference may be had if necessary.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for admitting flowable materials into moving containers having material-receiving portions surrounding inlets for flowable materials, comprising at least one material-supplying member; means for moving the at least one member along a predetermined path; means for advancing successive containers into positions of register with said at least one member; a combined centering and sealing device mounted on said at least one member for displacement toward and away from engagement with the material-receiving portion of a container which is in register with said at least one member; means for displacing said device; and energy storing means operating between said device and said displacing means to effect a movement of said device into engagement with the material-receiving portion of a container which is in register with said at least one member, said displacing means comprising a cam adjacent said path and a follower adjacent said energy storing means, said follower being movable with said at least one member and tracking said cam only in predetermined portions of said path said device comprises a sleeve having an external recess and a motion-receiving portion form-lockingly received in said recess, said energy storing means comprising a cylinder and piston unit between said displacing means and said motion receiving portion.

2. The apparatus of claim 1, wherein said unit comprises a cylinder element defining a chamber and a piston element extending into said chamber, one of said elements being provided on said motion receiving portion and the other of said elements being provided on said displacing means.

3. The apparatus of claim 2, wherein said energy storing means further comprises means for supplying a pressurized gaseous fluid into said chamber.

4. The apparatus of claim 1, wherein said cam includes a cam face for said follower, said cam face including portions which support said follower from below in at least one of said portions of said path.

5. The apparatus of claim 1, wherein said advancing means includes means for delivering successive containers into register with the at least one member when said at least one member moves along a first portion of said path and further comprising means for removing successive filled containers from positions of register with said at least one member when said at least one member moves along a second portion of said path, said cam having a first portion adjacent the first portion and a second portion adjacent said second portion of said path.

6. The apparatus of claim 1, wherein said path includes a first portion along which said at least one member moves prior to and a second potion along which said at least one member moves during admission of flowable material into a container which registers with said at least one member, said cam having a portion which is tracked by said follower during movement of said at least one member along the first portion of said path and which causes said follower to bear upon said energy storing means, said second portion of said path being located downstream of the first portion of said path in the direction of movement of said at least one member and said follower being disengaged from said cam during movement of said at least one member along said second portion of said path.

* * * * *